United States Patent [19]

Coles

[11] 4,048,893

[45] Sept. 20, 1977

[54] ELECTRONIC MUSICAL INSTRUMENT

[76] Inventor: Donald K. Coles, 2505 Capitol Ave., Fort Wayne, Ind. 46806

[21] Appl. No.: 664,903

[22] Filed: Mar. 8, 1976

Related U.S. Application Data

[63] Continuation-in-part of Ser. No. 496,806, Aug. 12, 1974, Pat. No. 3,943,811, and a continuation-in-part of Ser. No. 507,118, Sept. 18, 1974, Pat. No. 3,973,460.

[51] Int. Cl.[2] ..... G10C 3/12; G10H 1/00; G10H 5/06

[52] U.S. Cl. ..... 84/1.01; 84/1.24; 84/445; 84/451

[58] Field of Search ..... 84/1.01, 1.24, 428, 84/445–449, 451

[56] References Cited

U.S. PATENT DOCUMENTS

| | | | |
|---|---|---|---|
| 3,674,907 | 7/1972 | Derry | 84/1.01 |
| 3,800,600 | 3/1974 | Hallman, Jr. | 84/1.24 |
| 3,824,325 | 7/1974 | Obayashi et al. | 84/1.01 |
| 3,986,422 | 10/1976 | Coles | 84/1.01 |
| 4,009,633 | 3/1977 | Coles | 84/1.01 |

*Primary Examiner*—Stanley J. Witkowski

[57] ABSTRACT

Electronic tone transposition apparatus in an organ allows the front digitals of the keyboard to play different musical scales and to play the diatonic scale in different keys. The apparatus physically actuates a key signature of written music by interchanging the electrical coupling to a front digital with the coupling to its adjacent back digital. The number of such interchanges is equal to the number of flats or sharps in the key signature. The organ can be electronically switched so that the front digitals of the keyboard play different musical scales with different numbers of tones per octave span.

9 Claims, 15 Drawing Figures

FIG 1
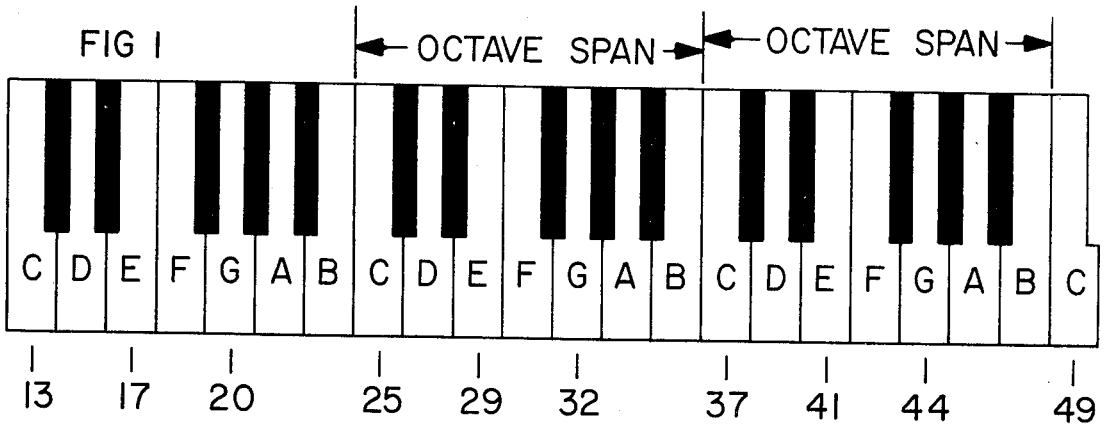
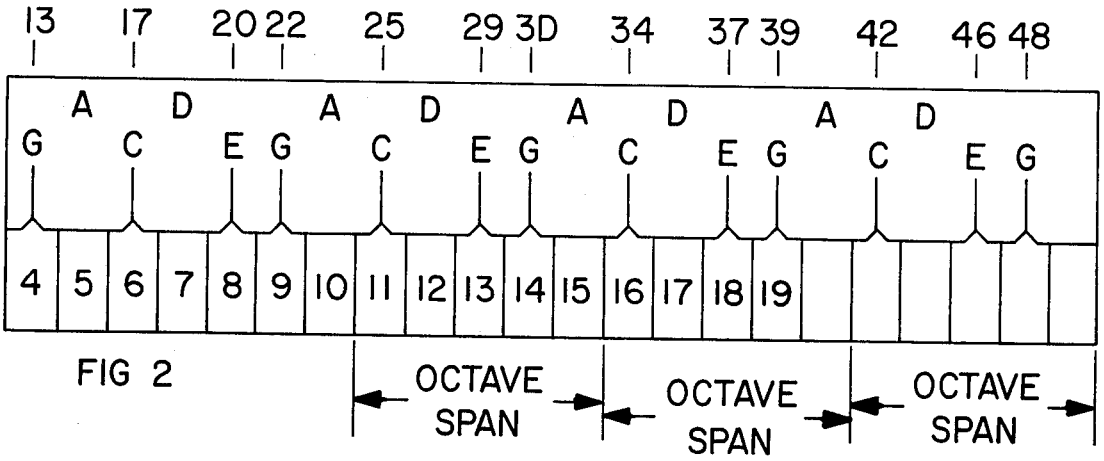
FIG 2
| OCTAVE | RELATIVE DIATONIC TONES | | | | | | | | | | | |
|---|---|---|---|---|---|---|---|---|---|---|---|---|
| | 1 C | 2 C# | 3 D | 4 D# | 5 E | 6 F | 7 F# | 8 G | 9 G# | 10 A | 11 A# | 12 B |
| 6 | 61 | | | | | | | | | | | |
| 5 | 49 | 50 | 51 | 52 | 53 | 54 | 55 | 56 | 57 | 58 | 59 | 60 |
| 4 | 37 | 38 | 39 | 40 | 41 | 42 | 43 | 44 | 45 | 46 | 47 | 48 |
| 3 | 25 | 26 | 27 | 28 | 29 | 30 | 31 | 32 | 33 | 34 | 35 | 36 |
| 2 | 13 | 14 | 15 | 16 | 17 | 18 | 19 | 20 | 21 | 22 | 23 | 24 |
| 1 | 1 | 2 | 3 | 4 | 5 | 6 | 7 | 8 | 9 | 10 | 11 | 12 |
FIG 3

FIG 4
| OCTAVE | RELATIVE PENTATONIC TONES | | | | | | | | | | | |
|---|---|---|---|---|---|---|---|---|---|---|---|---|
| | 1 C | 2 | 3 D | 4 | 5 E | 6 | 7 | 8 G | 9 | 10 A | 11 | 12 |
| 1 | 51 | | | | | | | | | | | |
| 2 | 42 | | 44 | | 46 | | | 48 | | 49 | | |
| 3 | 34 | | 36 | | 37 | | | 39 | | 41 | | |
| 4 | 25 | | 27 | | 29 | | | 30 | | 32 | | |
| 5 | 17 | | 18 | | 20 | | | 22 | | 24 | | |
| 6 | 8 | | 10 | | 12 | | | 13 | | 15 | | |
FIG 5
| OCTAVE | RELATIVE DIATONIC TONES | | | | | | | | | | | |
|---|---|---|---|---|---|---|---|---|---|---|---|---|
| | 1 C | 2 C# | 3 D | 4 D# | 5 E | 6 F | 7 F# | 8 G | 9 G# | 10 A | 11 A# | 12 B |
| 6 | | 61 | | | | | | | | | | |
| 5 | 50 | 49 | 51 | 52 | 53 | 55 | 54 | 56 | 57 | 58 | 59 | 60 |
| 4 | 38 | 37 | 39 | 40 | 41 | 43 | 42 | 44 | 45 | 46 | 47 | 48 |
| 3 | 26 | 25 | 27 | 28 | 29 | 31 | 30 | 32 | 33 | 34 | 35 | 36 |
| 2 | 14 | 13 | 15 | 16 | 17 | 19 | 18 | 20 | 21 | 22 | 23 | 24 |
| 1 | 2 | 1 | 3 | 4 | 5 | 7 | 6 | 8 | 9 | 10 | 11 | 12 |
FIG 6
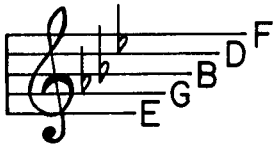
FIG 7
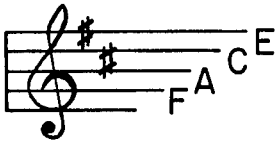

FIG. 12
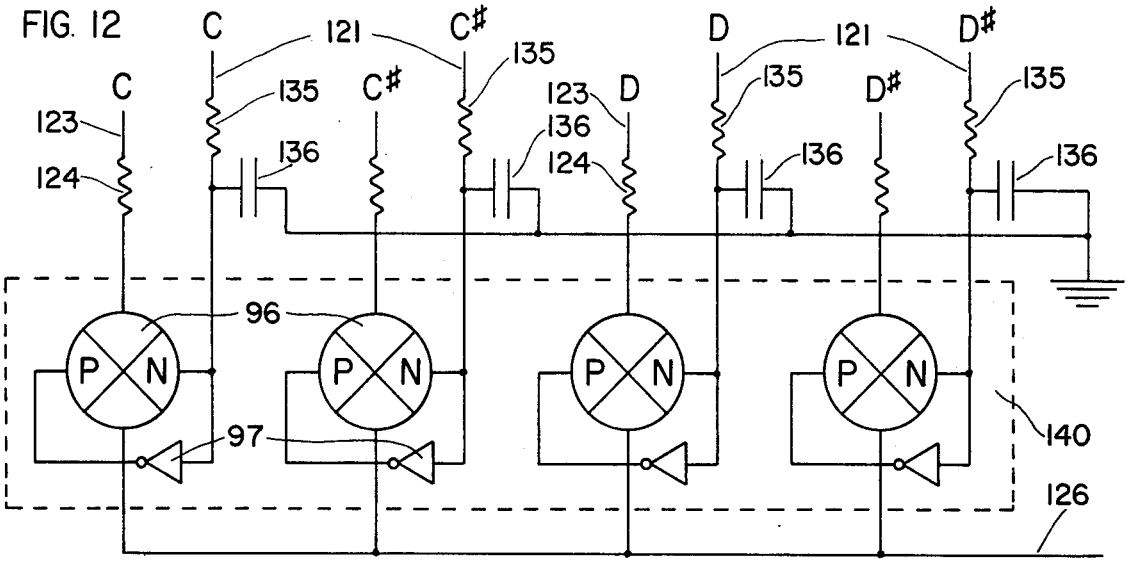
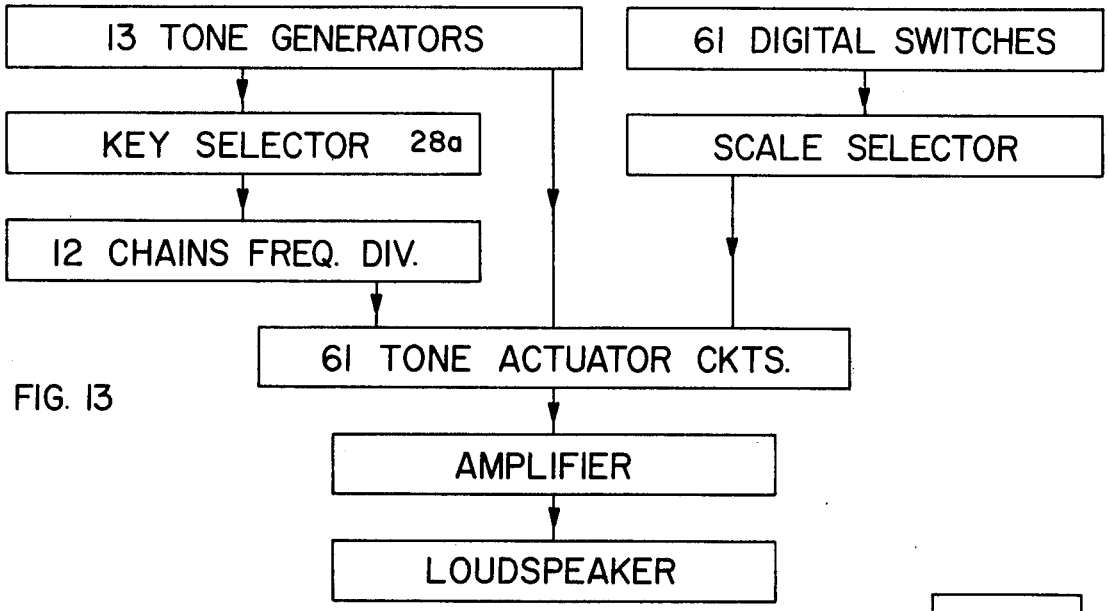
FIG. 13
FIG. 14
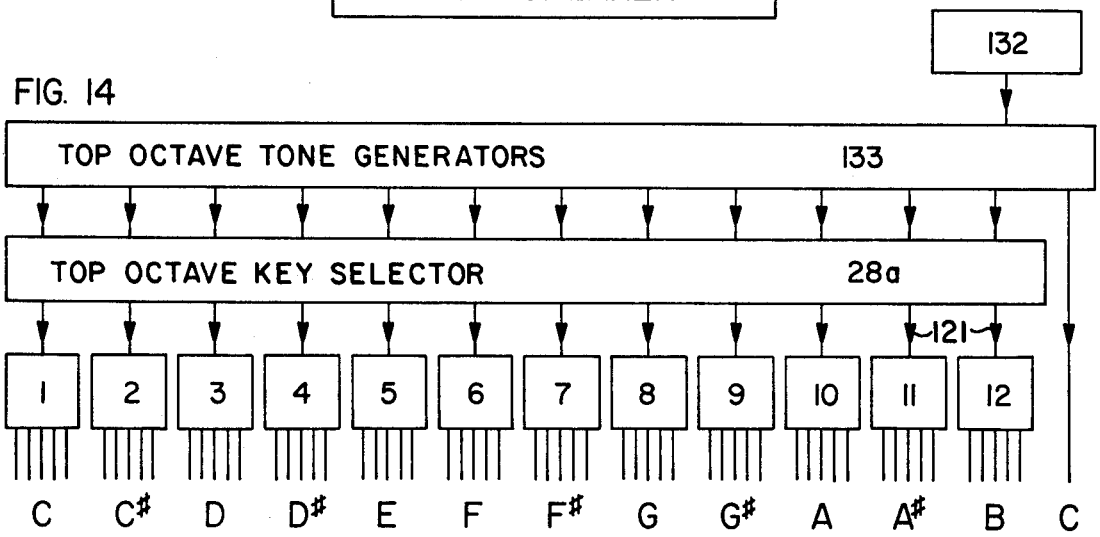

ELECTRONIC MUSICAL INSTRUMENT

CROSS REFERENCE TO RELATED APPLICATION

This is a continuation-in-part of applications Ser. No. 496,806 filed Aug. 12, 1974, and now U.S. Pat. No. 3,943,811, and a continuation-in-part of application Ser. No. 507,118, filed Sept. 18, 1974, and now U.S. Pat. No. 3,973,460.

BACKGROUND OF THE INVENTION

1. Field of the Invention

Means are provided for selecting out of the twelve tones of an octave those needed for any mode of the diatonic scale, and for selecting different musical scales.

2. Description of the Prior Art

During the twentieth century, most keyboard musical instruments in the United States have been tuned in an equitempered scale with twelve tones per octave. In the ideal equitempered scale, the fundamental frequencies of two consecutive tones differ by a factor equal to the twelfth root of two. Although no real instrument can be tuned exactly in the ideal equitempered scale, it is common to tune keyboard musical instruments in a twelve tone scale such that any two consecutive tones will have the ratio of their fundamental frequencies equal to the twelfth root of two within about one percent. The resulting musical scale may be called a nominally equitempered scale. The musical intervals between adjacent tones of the scale are considered to be equal to each other, and each of them is called a semitone.

Traditionally, keyboard instruments play seven of the twelve tones per octave on the front digitals of the keyboard, and the other five tones on the back digitals. Eight successive front digitals of the keyboard play the diatonic scale, the major mode of the diatonic scale being defined by the intertone musical intervals 2–2–1–2–2–2–1 semitones. In the United States, the labels commonly associated with the tones of the major mode of the diatonic scale are do-re-mi-fa-so-la-ti-do. When this mode is played on the keyboard in the key of C, the corresponding labels for the front digitals and for the tones they play are C-D-E-F-G-A-B-C.

In the traditional system of music notation, the C,D,E,F,G,A,B tones are represented by notes on the lines and spaces of a five line staff. An intermediate tone is represented by one of the above notes of the diatonic scale, together with a ♯ symbol or a ♭ symbol serving as a tone correction to that diatonic tone. Thus, a tone intermediate to the C and D tone is represented as C♯ or D♭, and it is played by a back digital positioned between the C and D front digitals.

For a musical composition to be played entirely on the front digitals of a conventional organ, it must be written in the diatonic key of C. A restraint such as this would severely limit a composer's freedom, for he probably wants to base the major mode of his scale on a tone above or below the absolute pitch of C.

In principle there are two ways to move the diatonic scale from one absolute pitch to a different absolute pitch. The preferred way for keyboard instruments would be to specify a movable C major scale in which the pitches played by all digitals are bodily moved a specified distance upward or downward —say four semitones upward. This method has not been available to past composers and their publishers, because most musical instruments have not possessed the pitch changing device which is required for this method.

A less satisfactory second method for specifying the absolute pitch of the diatonic scale is generally used by composers; they start the major mode of the diatonic scale on a front digital above or below the C digital. This method requires that one or more of the back digitals of the keyboard be included in the diatonic scale. For a given pitch of the major mode of the diatonic scale, the same back digitals must always be included. Consequently, the composer finds it convenient to include these particular sharps or flats in a key signature that is placed at the front of each line of written music.

The composer can start the major mode of his diatonic scale on any one of the seven front digitals in an octave span, and he can use either all flats or all sharps with each digital. Thus he uses fourteen different key signatures in addition to the key of C, which requires neither sharps nor flats.

The inexpert player has difficulty remembering and playing the sharps or flats called for in all those key signatures. To alleviate this difficulty, a keyboard instrument can be provided with a device to physically actuate the digital corrections included in the key signature. Such a device, called a key selector, can be set to the key signature by the musician; after that he can play the diatonic scale on the front digitals.

Philipps, in U.S. Pat. Nos. 466,907 and 519,071, has disclosed mechanical key selectors that can be set to physically actuate the key signatures of written music. When the device is set for a key signature with one flat, for example, the effects of the B and B♭ digitals are interchanged so that the B digital plays the B♭ tone. Thus, the player strikes the B digital, as indicated by a note on the staff, and gets the sound of B♭. If, in the written music, the player encounters a B natural sign, he must get the B natural tone by striking the B♭ digital.

A second type of key selector has been disclosed by Cornelius in U.S. Pat. No. 2,484,930. The Cornelius key selector has the advantage of keeping all tones in order on the keyboard so that the pitch played by each digital is higher than the pitch played by digitals on its left. This apparatus has cam-operated electrical switches associated with each digital; it has the disadvantage of requiring a major mechanical modification of the keyboard which provides two extra back digitals per octave span. If crowding at the back of the keyboard is to be avoided, the size of an octave span must be increased from about 164 mm to about 191 mm.

While the composer has made known the preferred absolute pitch of his musical composition by the location of his notes on the staff and by his key signature, the keyboard player may need to change the absolute pitch. He may need to accompany a singer or another musical instrument with a limited range of absolute pitch. A change of pitch can be accomplished without changing the key digital if a pitch changer is available which raises the pitch coupled to each digital by a fixed musical interval, such as four semitones. Many inventors have described pitch changers to be used by the keyboard player for this purpose.

The switches that I call pitch changers do not change the musical interval between tones played by adjacent digitals, which I call the interdigital intervals. For example, the interdigital musical interval between the C and D digitals is two semitones in the state of standard pitch, and it remains two semitones in all states of the pitch changer. Similarly, the interdigital musical interval between the B and C digitals remains one semitone in all states of the pitch changer. This characteristic of interdigital invariance distinguishes pitch changing switches from other members of the class of tone transposition switches. So far as I am aware, publically described electronic tone transposition switches all belong to this subclass of interdigital invariant switches.

The class of interdigital invariant switches can utilize simple constructions which are not available to the general class of tone transposition switches. An example is disclosed in my U.S. Pat. No. 3,949,638. In this simple pitch changer, a linear array of contacts permanently coupled to the digitals slides along a linear array of contacts permanently coupled to the tone generator circuits. Other examples of simple pitch changer structure are disclosed in U.S. Pats. Nos. 3,610,800 — DEUTSCH and 3,836,909 — COCKERELL.

An organ having an electronic switch that changes the interdigital musical intervals is disclosed but not claimed in my U.S. Pat. No. 3,943,811 column 8, lines 32 to 59 and FIG. 14. This electronic switch is used to select between the diatonic scale and the tonal pentatonic scale to be played on the front digitals of the keyboard. The application for that patent was copending with this application.

An electronic switch for selecting between the diatonic scale and a hexachord scale to be played on the front digitals was disclosed in my U.S. Pat. No. 3,973,460.

SUMMARY OF THE INVENTION

The organ has a conventional keyboard with a normal octave span containing seven front digitals and five back digitals. Digitals of the keyboard are coupled to tone actuator circuits via an electronic tone transposition network, controlled by manually operated switches. This electronic switching network has ten switch states which actuate diatonic key signatures having from one to five flats or from one to five sharps. The network has a standard switch state corresponding to the key of C, in which no sharps or flats are actuated.

When the switching network is set to actuate a key signature containing a sharp, couplings to the F and F# digitals are interchanged so that the F digital plays the F# tone. Such a switching operation necessarily affects some of the interdigital musical intervals. For example, the musical interval between the E digital and the F digital is changed from one semitone to two semitones, and the interdigital interval between the F digital and the G digital is changed from two semitones to one semitone.

My organ can also be electronically switched so that the keyboard octave span contains a different number of front digitals. In the preferred embodiment the organ can be electronically switched so that the keyboard octave span contains just five front digitals which play the tonal pentatonic scale. Again, many of the interdigital musical intervals are changed by this switching operation.

When the organ is arranged to play the pentatonic scale on the front digitals, the back digitals are hidden by a cover plate provided with markings to identify particular front digitals.

BRIEF DESCRIPTION OF THE DRAWINGS

FIG. 1 shows part of my organ keyboard as arranged to play the diatonic scale on the front digitals.

FIG. 2 shows part of my keyboard arranged to play the pentatonic scale on the front digitals.

FIG. 3 tabulates the digitals which play different musical tones when the organ is set for the diatonic key of C.

FIG. 4 tabulates the digitals which play different musical tones when the organ is set for the pentatonic scale.

FIG. 5 tabulates the digitals which play different musical tones when the organ is set to play in the diatonic key of D.

FIGS. 6, 7 show typical key signatures.

FIG. 9 is a wiring diagram for a typical electronic interchange switch module.

FIG. 12 shows details of the tone actuator circuits.

FIG. 13 diagrams a second embodiment.

FIG. 14 shows details of the second embodiment.

DESCRIPTION OF THE PREFERRED EMBODIMENT

Figure 8:
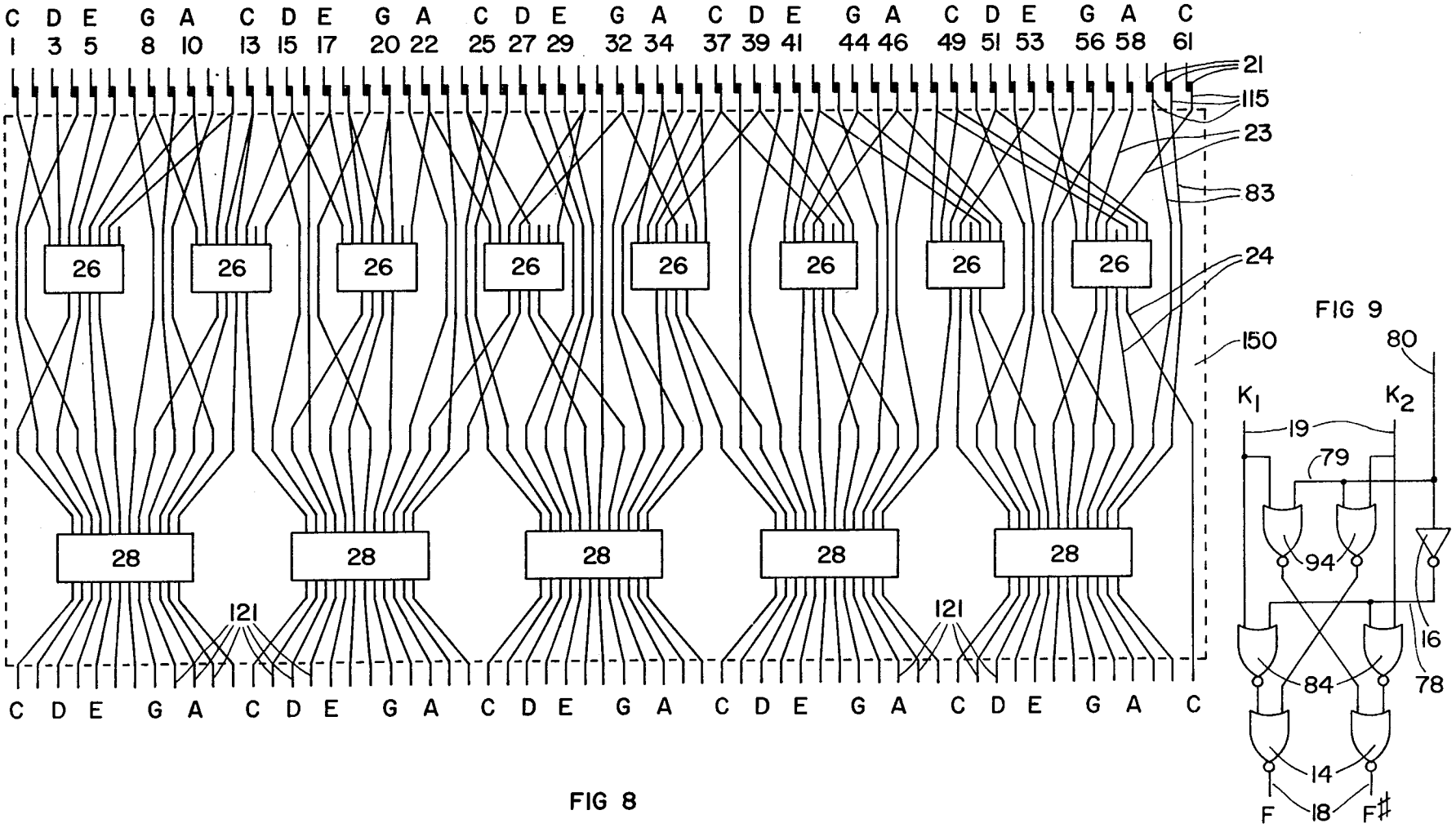
FIG. 8 diagrams the digital switches and my tone tranposition network.

My organ can be electronically switched so that the front digitals play either the diatonic scale or the tonal pentatonic scale. When playing the diatonic scale, the appearance of the keyboard is as shown in FIG. 1. When playing the pentatonic scale, the appex of the keyboard is as shown in FIG. 2. In this second arrangement, the back digitals are covered up by a plastic cover which bears marks for identifying different digitals.

Since the digitals in my organ can not be uniquely identified by the tones they play, the digitals in my organ are instead identified by a set of ordinal numbers K, which range from one to sixty one. These numbers increase steadily when proceeding from left to right on the keyboard. The total of sixty-one digitals includes thirty-six front digitals and twenty-five back digitals.

As shown in FIG. 1, when my organ is arranged for playing the diatonic scale, the keyboard octave span contains seven front digitals and five back digitals. To avoid ambiguity, I define the octave span as the center-to-center distance between two digitals which control tones an octave apart. Although defined as a center-to-center distance, this distance may, of course, be measured between any corresponding points of the two digitals, or between the cracks to the immediate left of the two digitals. As shown in FIG. 1 each front digital has a narrow playing surface that extends to the back of the keyboard.

Referring still to FIG. 1, the sequence of seven front digitals in each marked octave span normally plays the sequence of tones C-D-E-F-G-A-B. This particular sequence is the major mode of the diatonic scale. A sequence of relative tones of increasing pitch may be defined by the intertone intervals between consecutive tones of the sequence. Thus a particular mode of a musical scale is characterized by the intertone intervals between its adjacent tones, not by their absolute pitch. For example, the major mode of the diatonic scale is defined by the sequence of intertone intervals 2-2-1-2-2-2-1 semitones.

The number of intertone intervals used to define a mode of the musical scale is equal to the number of different tones in the mode, the last intertone interval being measured between the last tone of the mode and an extra tone which is one octave above the lowest tone of the mode. Thus the sum of the intertone intervals defining a musical mode is equal to twelve semitones. When a given sequence of tones of increasing pitch is played by a sequence of digitals, the intertone intervals of the sequence of tones are the interdigital intervals of the sequence of digitals.

When my scale selector is set for the diatonic scale, any eight consecutive front digitals will play one of the seven cyclic modes of the diatonic scale:

C-D-E-F-G-A-B-C,
D-E-F-G-A-B-C-D,
E-F-G-A-B-C-D-E,
F-G-A-B-C-D-E-F,
G-A-B-C-D-E-F-G,
A-B-C-D-E-F-G-A,
B-C-D-E-F-G-A-B.

Since a musical scale is characterized by relative pitches only, the above modes of the diatonic scale are fully defined by the sequences of interdigital musical intervals:

2-2-1-2-2-2-1 semitones,
2-1-2-2-2-1-2 semitones,
1-2-2-2-1-2-2 semitones,
2-2-2-1-2-2-1 semitones,
2-2-1-2-2-1-2 semitones,
2-1-2-2-1-2-2 semitones,
1-2-2-1-2-2-2 semitones.

When my tone transposition apparatus is set to play the diatonic scale in the key of C, the first eight front digitals shown in FIG. 1 play the sequence of tones, C-D-E-F-G-A-B-C. When my tone transposition apparatus is set to play in another diatonic key, these first eight front digitals play a different cyclic mode of the diatonic scale.

FIG. 3 shows the numbers K of all digitals tabulated according to the musical tones that they play when the electronic tone transposition network is set for the key of C. In this particular arrangement, the pitch played by the digitals increases regularly from left to right.

FIG. 2 shows part of the keyboard as arranged to play the tonal pentatonic scale on the front digitals, with five front digitals per octave span. In this case the back digitals are hidden by a cover, which carries marks to indicate the C, E and G digitals. The reduced octave span is only 117 mm, as compared with 164 mm for the diatonic scale. Since the pentatonic arrangement of the keyboard shows only the front digitals, these front digitals are designated by a separate set of ordinal numbers L that run from 1 to 36; the middle C digital, which is labeled K = 25, being also labeled L = 11.

In this pentatonic arrangement, front digitals labeled L = 11, 12, 13, 14, 15 play the tones conventionally labeled C,D,E,G,A respectively. I call this sequence of tones the major mode of the tonal pentatonic scale. The front digital labeled L = 16 plays the tone C, one octave above the tone played by the digital labeled L = 11. Throughout the keyboard, each front digital designated by a number L (greater than 5) plays a tone one octave above the tone played by the front digital designated by the number L − 5.

When my scale selector is set for the tonal pentatonic scale, any six consecutive front digitals will play one of the five cyclic modes of that scale:

C-D-E-G-A-C,
D-E-G-A-C-D,
E-G-A-C-D-E,
G-A-C-D-E-G,
A-C-D-E-G-A.

The corresponding sequences of interdigital musical intervals for the sequence of six digitals are:

2-2-3-2-3 semitones,
2-3-2-3-2 semitones,
3-2-3-2-2 semitones,
2-3-2-2-3 semitones,
3-2-2-3-2 semitones.

In changing the keyboard so that a pentatonic scale is played on the front digitals, instead of the diatonic scale, some interdigital musical intervals are necessarily changed. This can be seen by comparing the interdigital musical intervals in FIGS. 1 and 2. Considering for example the pair of adjacent front digitals labeled K = 29,30 (L = 13,14) it is seen that the interdigital interval changes from one semitone in the diatonic state to three semitones in the pentatonic state. The connections of my electronic tone transposition network to the digital switches are diagramed in FIG. 8.

Referring to FIG. 8, digital switches 21 are attached to the bottom side of the digitals, there being one digital switch for each digital. The digital switches are identified by the same set of numbers K running continuously from one to sixty-one. Letter labels are also provided to show the tones normally played by these digitals, when the switch network is set for the diatonic key of C.

My electronic switching network 150 is shown enclosed within the dotted box. The eight modules 26 are used to switch from the diatonic scale to the pentatonic scale. The five modules 28 are used to actuate flats and sharps when playing in the diatonic scale. The modules 26 and 28 are interlocked so that when the scale selector is set for the pentatonic scale, the diatonic key selector is automatically set for the key of C.

Leads 23 couple most of the front digitals to the eight scale changer modules 26. Leads 83, which by-pass these scale changer modules, originate in four front digitals and in the twenty-five back digitals.

All eight scale changer modules 26 are identical. Each consists of an inverter and wiring to four AND-OR select gates. The wiring for three typical modules is shown in FIG. 10A.

Figure 10A:
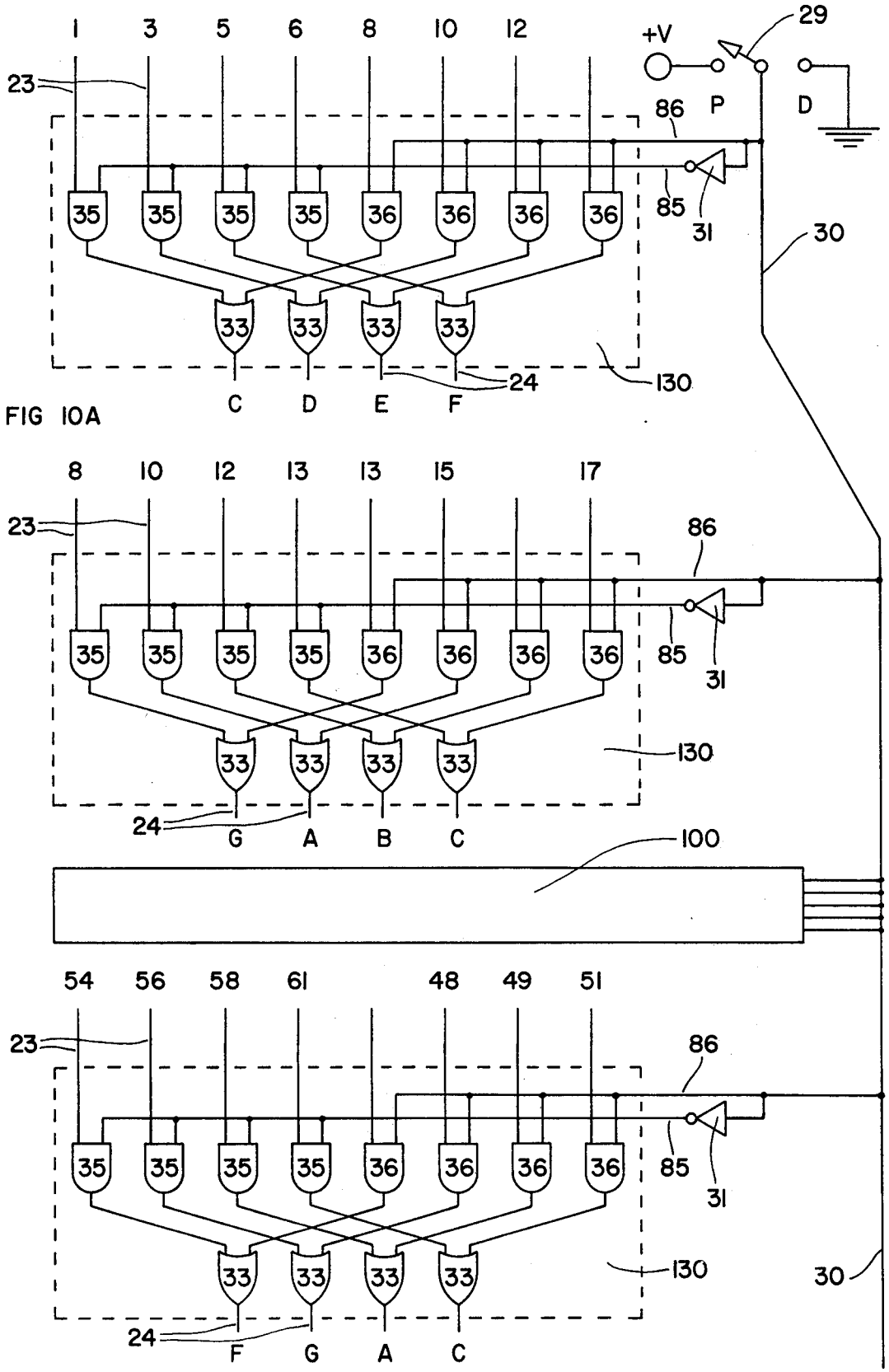
FIGS. 10A and 10B detail my electronic tone transposition network, FIG. 10B being a continuation of FIG. 10A at its lower edge.

Referring to FIG. 10A, the moving contact of manually operated switch 29 can be set to a positive potential V (such as 15 volts) to play in the pentatonic scale, or it can be set to ground potential to play in the diatonic scale.

Each switch assembly 130 within a dotted box is manufactured commercially as an integrated circuit package. This package contains four AND-OR gates. In my organ, the upper control rail 86 in each package controls the four pentatonic AND gates 36, while the lower control rail 85 controls the four diatonic AND gates 35. OR gates 33 have output leads 24, labeled according to the tones they actuate (when the key selector modules are inactive). The Boolean algebraic switch equation and the truth table for each AND-OR gate are given below.

| | Upper Rail U | Lower Rail L | Output X |
|---|---|---|---|
| X = P.U + D.L | 0 | 0 | 0 |
| | 1 | 0 | P |
| | 0 | 1 | D |
| | 1 | 1 | P + D |

Where

X is the output potential for actuating a tone,

D is the input potential from the front digital playing the tone in the diatonic scale, P is the input potential from the front digital playing the tone in the pentatonic scale, U is the potential on the upper control rail.

L is the potential on the lower control rail.

Manually operated switch 29 can be set to produce either a positive or zero potential on control lead 30, this potential being applied directly to upper control rail 86. Inverter 31 inverts the potential and applies it to the lower control rail 85. In view of the inverted connection to the lower control rail, the switch equation and the truth table can be expressed in terms of the upper control rail potential U and its negation $\overline{U}$.

| | U | X |
|---|---|---|
| $X = P.U + D.\overline{U}$ | 1 | P |
| | 0 | D |

We refer now to the first module shown in FIG. 10A. When lead 30 is grounded, the lowest diatonic tones C,D,E,F are played by digitals 1,3,5,6. When lead 30 is raised to a potential of +15 volts, three of these tones are played by digitals 8,10,12. The fourth tone F is not played by any digital since this tone is not included in the tonal pentatonic scale.

Referring to the second module in FIG. 10A: when lead 30 is grounded, the successive diatonic tones G,A,B,C are played by digitals 8,10,12,13. When lead 30 is raised to +15 volts, three of these tones are played by digitals 13,15,17. The tone B is not played by any digital since this tone is not included in the tonal pentatonic scale.

The third to seventh modules 26 in FIG. 8 are represented by block 100 in FIG. 10A. The digital-to-tone couplings for these modules are tabulated in FIGS. 3 and 4. FIG. 3 shows labels K of digitals playing the different tones when the manual switch 29 of FIG. 10A is set for the diatonic scale; FIG. 4 shows labels K of digitals playing the same tones when the manual switch is set for the pentatonic scale. A comparison of FIGS. 3 and 4 shows that many of the interdigital musical intervals are changed in making the switch. Considering, for example, the pair of adjacent front digitals labeled K = 12,13, it is seen that the interdigital interval changes from one semitone in the diatonic state (FIG. 3) to three semitones in the pentatonic state (FIG. 4).

Referring to the last module in FIG. 10A: when lead 30 is grounded, the four high diatonic tones F,G,A,C are played by digitals 54,56,58,61. When lead 30 is raised to +15 volts, three of these tones are played by digitals 48,49,51. The highest B tone, played by digital 60, by-passes the switching module 26. Output signals from all eight scale-switching modules proceed next to the key selector modules.

When my tone transposition apparatus is set for the pentatonic scale, any six consecutive front digitals play one of the cyclic modes of the tonal pentatonic scale, as previously defined. When the tone transposition apparatus is set for the diatonic scale, any eight consecutive front digitals play one of the cyclic modes of the diatonic scale, as previously defined.

FIGS. 6,7 show typical diatonic key signatures containing three flats, two sharps respectively. The key signature for two sharps specifies that F notes should be played as the F# and tone C notes played as the C# tone. My key selector switch can be set to make these tone substitutions.

Normally, when my key selector is set for the diatonic key of C, the F digital plays the F tone and the C digital plays the C tone. But when the key selector is set for a signature containing one sharp, the F digital plays the F# tone and the F# digital plays the F tone. Thus the couplings from the F and F# digitals are interchanged. When my key selector is set for two sharps, the couplings from the C and C# digitals are also interchanged. And so on.

Referring back to FIG. 8, signals from digital switches 21 either pass through scale changer modules 26 or bypass them. Sixty of these signals then proceed to the five key selector modules 28 which, under control of a set of eleven pushbuttons, actuate the sharps or flats in the key signature. The key selector control is shown in FIG. 10B, which is a continuation of FIG. 10A at its lower edge.

Figure 10B:
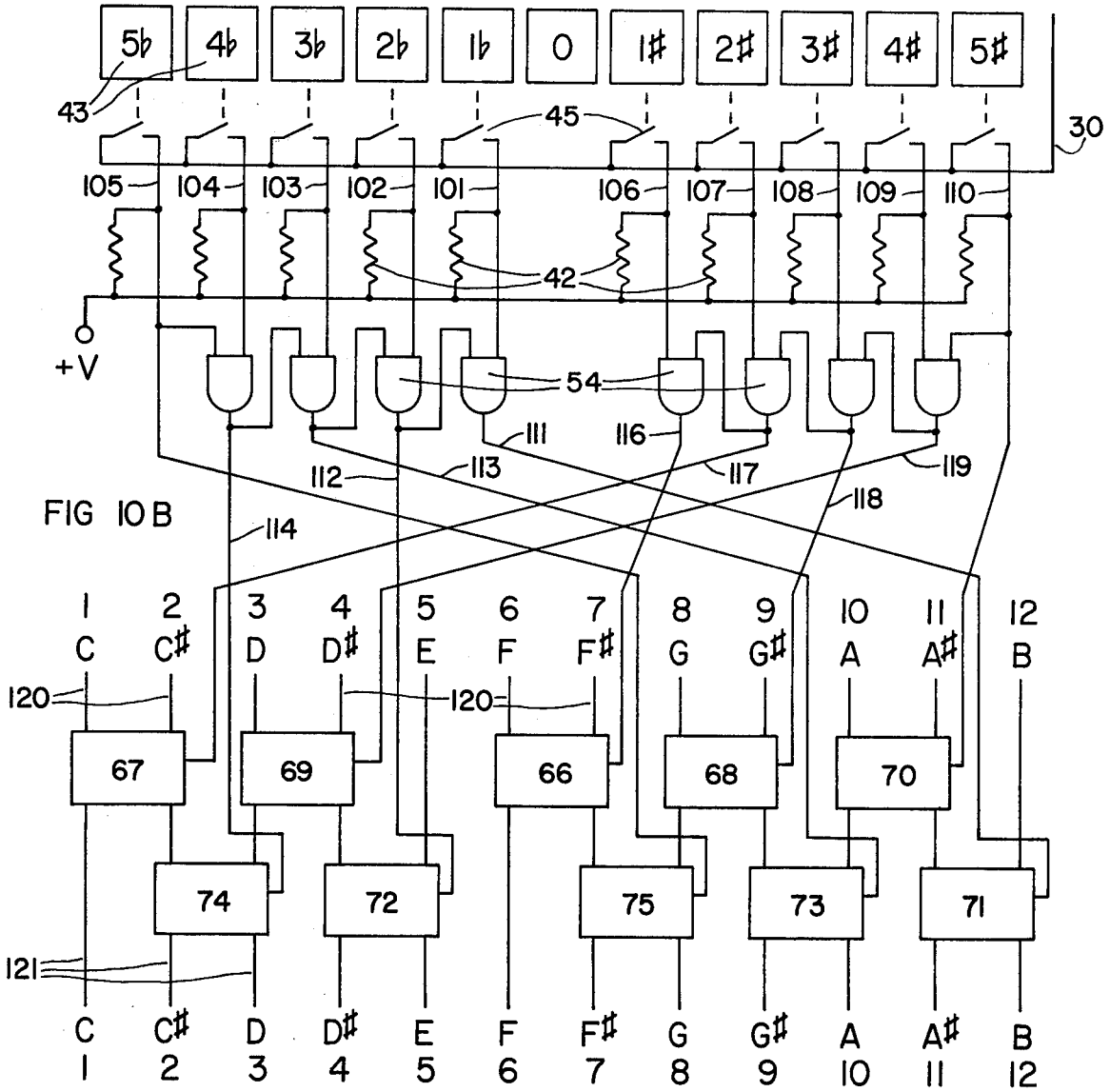

Referring to FIG. 10B, pushbuttons 43 are labeled to correspond to key signatures with from one to five flats or from one to five sharps. Pushbutton switches 45 are closed by each pushbutton except the central pushbutton, which corresponds to the key of C. When one pushbutton is depressed, it latches down and releases the previously latched pushbutton. Only one pushbutton can be latched down at a time. These eleven pushbuttons control the five identical key selector modules 28 shown in FIG. 8. Only one of these is shown in FIG. 10B. Control lead 30, a continuation from FIG. 10A, must be grounded for the key selector module to be operative. This condition is always satisfied when scale selector switch 29 of FIG. 10A is set for the diatonic scale.

Each key selector module contains a set of ten interchange modules 66-75. Twelve signal input leads 120 leading to each key selector module carry signals from the digital switches via signal leads 24 and 83, shown in FIG. 8. Input leads 120 to the key selector module shown in FIG. 10B are numbered to correspond to the first octave of digitals in the keyboard. Output signals from the set of interchange modules are carried on output leads 121. These output leads 121 have letter labels corresponding to the tones they actuate.

In the state corresponding to the key of C (with the central pushbutton depressed), the potential at the output leads 101-110 of all pushbutton switches is held at +15 volts by pullup resistors 42. In this condition, the output leads 111-114 and 116-119 from AND gates 54 are also held at +15 volts. Thus the control leads to all interchange modules 66-75 of the five key selector modules are at a potential of +15 volts. This potential keeps the interchange modules in their normal state, in which input leads are coupled to their normal output leads (shown directly below the input leads).

The ten interchange modules 66-75 of all key selector modules are identical. A diagram for a typical interchange module is shown in FIG. 9. Each module comprises six NOR gates. Output signal leads 18 are connected to two output NOR gates 14. Input signal leads 19 are connected to a first pair of input NOR gates 84 and a second pair of input NOR gates 94. Control lead 80 is connected directly to upper control rail 79 and via inverter 16 to lower control rail 78.

The upper control rail affects NOR gates 94 and the lower control rail affects NOR gates 84. In the normal state, control leads 80 is at +15 volts, NOR gates 94 are disabled, with a grounded output, and NOR gates 84 are enabled. Thus the output lead labeled F follows the potential of the input lead labeled $K_1$, the output lead labeled F# follows the potential of the input lead labeled $K_2$; there is no interchange.

On the other hand, if control lead 80 is grounded, it enables NOR gates 94 and disables NOR gates 84, so that the output lead labeled F follows the potential of the input lead labeled $K_2$, and the output lead labeled F# follows the potential of the input lead labeled $K_1$. The couplings from the input leads labeled $K_1$ and $K_2$ are interchanged.

The switch equation and truth table for this module are shown below.

| | U | F | F# |
|---|---|---|---|
| $F = U \cdot K_1 + \overline{U} \cdot K_2$ | 1 | $K_1$ | $K_2$ |
| $F\# = U \cdot K_2 + \overline{U} \cdot K_1$ | 0 | $K_2$ | $K_1$ |

where

F is the output signal potential on the lead labeled F (actuating an F tone),

F# is the output signal potential on the lead labeled F# (for actuating an F# tone), $K_1$ is the input signal potential on the lead labeled $K_1$ (from the digital that normally plays the F tone), $K_2$ is the input signal potential on the lead labeled $K_2$ (from the digital that normally plays the F# tone), U is the control potential on the upper control rail 79.

We refer again to FIG. 10B. When one of the ten pushbutton switches 45 is closed; its output lead assumes the potential of lead 30 from switch 29 in FIG. 10A. If this switch is set for the pentatonic scale, lead 30 is at +15 volts, so that closure of any pushbutton switch 45 will have no effect. However, when switch 29 in FIG. 10A is set for the diatonic scale, lead 30 in FIGS. 10A and 10B is grounded. If now the pushbutton labeled 1♭ is depressed, it grounds lead 101 running to its corresponding AND gate 54, thereby grounding output lead 111 and activating the interchange module 71 in each key selector module. The couplings to the B and B♭ digitals are thus interchanged; the B digital plays the B♭ tone and the B♭ digital plays the B tone.

If the pushbutton labeled 2♭ is depressed, it grounds lead 102 running to its corresponding AND gate, thereby grounding output lead 112 and activating interchange module 72. The E digital plays the E♭ tone, the E♭ digital plays the E tone. In addition, an input to the 1♭ AND gate is grounded so that its output is also grounded and module 71 is activated. Thus in addition the B digital plays the B♭ tone and the B♭ digital plays the B tone.

Similarly, when the 3♭ pushbutton is depressed, the A and A♭ couplings are interchanged, the E and E♭ couplings are interchanged, and the B and B♭ couplings are interchanged.

When the 4♭ pushbutton is depressed, the three previous pairs of couplings are interchanged; in addition the D and D♭ couplings are interchanged.

When the 5♭ pushbutton is depressed, the four previous pairs of couplings are interchanged, and in addition the G and G♭ couplings are interchanged. The B♭,A♭,G♭ digitals are the same as the digitals labeled A#,G#,F# respectively.

The same kind of action takes place when pushbuttons corresponding to key signatures with sharps are depressed. When the pushbutton labeled 1# is depressed, it grounds lead 106 running to its corresponding AND gate 54, thereby grounding output lead 116 and activating interchange module 66 in each key selector module. The couplings to the F and F# digitals are thus interchanged; the F digital plays the F# tone and the F# digital plays the F tone.

If the pushbutton labeled 2# is depressed, it grounds lead 107 running to its corresponding AND gate, thereby grounding output lead 117 and activating interchange module 67. The C digital plays the C# tone and the C# digital plays the C tone. In addition, an input to the 1# AND gate is grounded so that its output is also grounded and interchange module 66 activated. Thus in addition the F digital plays the F# tone and the F# digital plays the F tone.

FIG. 5 tabulates the labels K of digitals playing the twelve tones in each octave of the keyboard when the pushbutton corresponding to a key signature containing two sharps is depressed. Comparing columns in FIG. 5 with those for the same tones in FIG. 3, it is seen that all F,F# digitals are interchanged with each other and all C,C# digitals are interchanged with each other.

Or fixing attention on a particular pair of digitals, say digitals labeled K = 6,7, it is seen that in switching from the key of C state to the key of D state, the tones F,F# are interchanged.

In any such change of state of my key selector switch, some of the interdigital musical intervals are necessarily changed. Considering, for example, the pair of adjacent front digitals labeled K = 5,6, it is seen that the interdigital interval changes from one semitone in the key of C state (FIG. 3) to two semitones in the key of D state (FIG. 5).

Continuing with FIG. **10*b*, when the 3#** pushbutton is depressed, the F and F# couplings are interchanged, the C and C# couplings are interchanged, the G and G# couplings are interchanged.

When the 4# pushbutton is depressed, the three previous pairs of couplings are interchanged, in addition the D and D# couplings are interchanged.

When the 5# pushbutton is depressed, the four previous pairs of couplings are interchanged, in addition the A and A# couplings are interchanged.

When a key signature containing six sharps is encountered, the 5# pushbutton is depressed; the sixth sharp (E#) is actuated manually by playing the next back digital to the right of the E front digital.

When the central pushbutton in FIG. 10B is depressed, the major mode of the diatonic scale is played by the sequence of seven digitals labeled K = 13 to 24 in FIG. 1. When one of the other pushbuttons is depressed, these same digitals play one of the other cyclic modes of the diatonic scale. The relative tones played by this sequence of digitals for the eleven different switch states are shown in Table 1, column 2. The third column of Table 1 shows the intertone intervals for each of these cyclic modes. An asterisk in each sequence of intertone intervals indicates the position of the tonic note of the major mode.

TABLE 1

| | RELATIVE TONES | | | | | | | INTERTONE INTERVALS |
|---|---|---|---|---|---|---|---|---|
| 5# | C# | -D# | -E | -F# | -G# | -A# | -B | -2-1-2-2-2-1*2 |
| 4# | C# | -D# | -E | -F# | -G# | -A | -B | -2:1*2-2-1-2 |
| 3# | C# | -D | -E | -F# | -G# | -A | -B | -1-2-2-2-1*2-2 |
| 2# | C# | -D | -E | -F# | -G | -A | -B | -1*2-2-1-2-2-2 |
| 1# | C | -D | -E | -F# | -G | -A | -B | -2-2-2-1*2-2-1 |
| 0 | C | -D | -E | -F | -G | -A | -B | *2-2-1-2-2-2-1 |
| 1♭ | C | -D | -E | -F | -G | -A | -B♭ | -2-2-1*2-2-1-2 |
| 2♭ | C | -D | -E♭ | -F | -G | -A | -B♭ | -2-1-2-2-2-1*2 |

TABLE 1-continued

| | RELATIVE TONES | | | | | | | INTERTONE INTERVALS |
|---|---|---|---|---|---|---|---|---|
| 3♭ | C | -D | -E♭ | -F | -G | -A♭ | -B♭ | -2-1*2-2-1-2-2 |
| 4♭ | C | -D♭ | -E♭ | -F | -G | -A♭ | -B♭ | -1-2-2-2-1*2-2 |
| 5♭ | C | -D♭ | -E♭ | -F | -G♭ | -A♭ | -B♭ | -1*2-2-1-2-2-2 |

The eleven different pushbuttons produce all seven cyclic modes; moreover, four of the cyclic modes are produced by two different pushbutton. For example, both the 3♭ and the 4# push buttons produce the minor mode on the sequence of digitals labeled K = 13 to 24 in FIG. 1.

Referring still to FIG. 10B, output signals from each key selector module, carried on output leads 121, are used to actuate the musical tones. A group of twelve tone actuator circuits is shown in FIG. 11.

Figure 11:
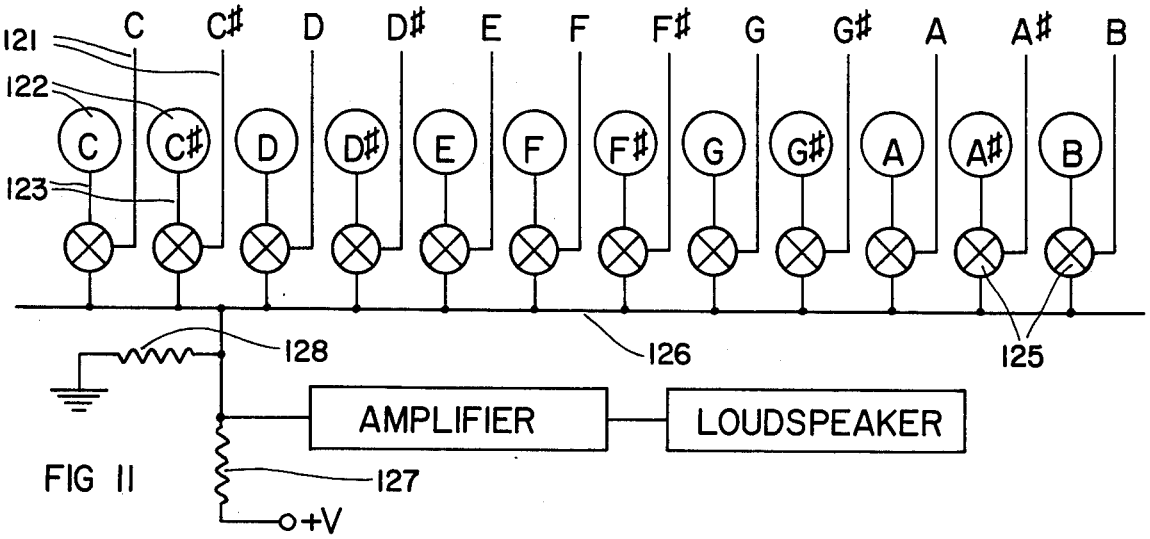
FIG. 11 shows some of the tone actuator circuits.

Referring to FIG. 11, audio frequency signals from the tone generator circuits 122 pass through A.C. input leads 123 and tone actuator circuits 125 to busbar 126. This busbar is connected to load resistors 127,128, and to the bus amplifier and loudspeaker. The tone actuator circuits conduct only when a positive potential signal from one or more digital switches is impressed on the corresponding D.C. input leads 121. Details of the first four of these tone actuator circuits are shown in FIG. 12.

Referring to FIG. 12, the dotted box 140 is a commercially available package which contains four bilateral switches 96 and four inverters 97. Audio frequency signals from the tone generators pass through A.C. input leads 123 and resistors 124 to the bilateral switches 96. Each bilateral switch comprises a P-channel labeled P and an N-channel labeled N.

When a digital in the keyboard is depressed, a positive potential appears on one of the D.C. input leads 134; it passes through resistor 135 to the gate of an N-channel of switch 96, causing the N-channel to conduct. At the same time the positive potential from the digital switch is inverted by inverter 97 and applied to the gate of the P-channel of switch 96, so that it also conducts. This action allows bilateral switch 96 to conduct its audio frequency signal to busbar 126. The low pass filter formed by resistor 135 and its capacitor 136 reduces the audibility of a click due to closure of the digital switch.

In FIGS. 9,10 and 11 the commercial components are as follows:

16,31 are SCL 4009A,
14,84,94 are SCL 4001A,
54 are SCL4081B
130 are SCL 4019A,
140 are SCL 4016A,
42 are 10 kilohms,
124,135 are 100 kilohms,
127,128 are 3 kilohms,
136 are 0.03 Mfd.

All of the integrated circuit packages are manufactured by Solid State Scientific, Inc.

OTHER EMBODIMENTS

Instead of having all independent tone generator circuits, a set of only thirteen top octave generator circuits may be provided. Lower octaves are then derived from the top octave by twelve chains of frequency dividers. This arrangement is diagramed in FIG. 13. The digital switches, scale selector, tone actuators, amplifier and loud-speaker are the same as in the preferred embodiment; the five key selector modules of FIG. 8 are replaced by permanent wiring corresponding to the normal state of the key selector. A top octave key selector is positioned between the top octave tone generators and the frequency dividers. The tone generators, key selector and chains of frequency dividers of FIG. 13 are further detailed in FIG. 14.

Key selector 28*a,* shown in FIG. 14, is identical to the key selector module shown in FIG. 10B, but only one module is needed instead of the five modules needed for the preferred embodiment. This key selector module will switch audio frequency signals from the tone generators just as well as the D.C. signals from the digital switches, provided that square wave signals of the proper amplitude are produced by the tone generator circuits.

Referring to FIG. 14, square wave tone signals are produced by the top octave tone generators 133. These square wave tone signals are coupled to the input leads of key selector 28*a* in accordance with the letter labels of input leads 120 in FIG. 10B. Twelve chains of frequency dividers 1-12 of FIG. 14 are connected to the output leads from the key selector, connections being made in accordance with the numerical labels of output leads 121 of FIG. 10B.

When the central pushbutton of FIG. 10B is depressed, the major mode of the diatonic scale is actuated by those output leads 121 which are labeled 1,3,5,6,8,10,12. When another pushbutton is depressed, these seven output leads actuate one of the other cyclic modes of the diatonic scale. These seven output leads are all coupled via the chains of frequency dividers and tone actuators to front digitals of the keyboard.

Referring to FIG. 14, the sixty audio outputs from the twelve chains of frequency dividers are labeled according to the tones they actuate when the key selector is set for the key of C. These sixty audio outputs from the dividers proceed to the A.C. inputs 123 of the tone actuator circuits, twelve of which are shown in FIG. 11.

In FIG. 14, top octave generator 133 receives a 500 kHz signal from oscillator 132. This crystal controlled oscillator is L24R2, marketed by the Connor-Winfield Corporation. The top octave generator 133 is MK50240, manufactured by the Mostek Corporation. The outputs from this package provide the input frequency divided by 239,253,268,284,301,319,338,358,379,402, 426,451 and 478. Chains of frequency dividers 1-12 are binary counters SCL4024A, manufactured by Solid State Scientic, Inc. Output signals from each of these packages provide the input frequency divided by 2,4,8,16,32,64, and 128.

In the preferred embodiment, the 61 independent tone generators oscillate continuously. In an alternate embodiment, the 61 independent tone generators oscillate only when a positive voltage is coupled to them from their corresponding digitals. In this arrangement, each tone generator and its tone actuator are combined.

While my electronic scale selector switch has been described as a switching choice between the diatonic scale and the tonal pentatonic scale, the invention is applicable to choices between the diatonic scale and other musical scales. Of particular interest are the diminished diatonic scales derived from the diatonic scale by the omission of one or two of its tones. Thus the tonal pentatonic scale is derived from the diatonic scale in the key of C by omitting the F and B tones.

Another example of a diminished diatonic scale is the hexachord scale, which is derived from the diatonic scale in the key of C by omitting the B tone. Such scale changes on the front digitals of the keyboard always change some of the interdigital musical intervals between adjacent front digitals.

The playing of pentatonic or hexatonic musical scales on the front digitals of an organ keyboard can be characterized by labeling the front digitals in order by consecutive ordinal numbers L, as shown in FIG. 2. We select a whole number M which would be 5 for a pentatonic scale or 6 for a hexatonic scale. Then each front digital labeled by an ordinal number L which is greater than M will play a tone an octave above the tone played by the digital labeled L-M. In other words, the keyboard octave span contains exact M front digitals.

I claim:

1. In an electrically keyed musical instrument, tone transposition apparatus comprising:

means for generating two individual musical tones differing in pitch by a single semitone, first and second manually operated digitals, individual digitals playing individual ones of the musical tones, electrical switching means coupling the digitals to the tone generating means, the electrical switching means having first and second switch states, the difference between the switch states being an interchange of the tones played by the first and second digitals.

2. In an electrically keyed musical instrument, tone transposition apparatus comprising:

electrical means for generating first and second individual musical tones, the second tone having a pitch one semitone above that of the first tone, electrical switching means coupled to the tone generator means, the electrical switching means having at least first and second electrical output leads, and first and second switch states, the difference between the two switch states being an interchange of the tones at the first and second electrical output leads, in the first switch state, the first output lead actuating the first musical tone, the second output lead actuating the second musical tone, in the second switch state, the first output lead actuating the second musical tone, the second output lead actuating the first musical tone.

3. In an electrically keyed musical instrument, tone transposition apparatus comprising:

means for generating twelve individual musical tones, the tones arranged in a single sequence in order of increasing pitch, with intertone intervals of a single semitone between consecutive members of the sequence, twelve manually operated digitals including first and second digitals, the digitals playing individual members of the sequence of musical tones, electrical switching means coupling the digitals to the tone generating means, the electrical switching means having at least first and second switch states, a difference between the switch states being the interchange of the tones played by the first and second digitals, in the first switch state, the second digital playing a tone one semitone above the tone played by the first digital, in the second switch state, the first digital playing a tone one semitone above the tone played by the second digital.

4. In a musical instrument, tone transposition apparatus comprising:

electrical means for generating twelve individual musical tones, the tones arranged in a single sequence in order of increasing pitch, with intertone intervals of a single semitone between consecutive members of the sequence, electrical switching means coupled to the tone generator means, the electrical switching means having at least first and second electrical output leads, in the first switch state, the second output lead actuating a tone one semitone above the tone actuated by the first output lead, in the second switch state, the first output lead actuating a tone one semitone above the tone actuated by the second output lead.

5. An electrically keyed keyboard musical instrument which plays in a diminished diatonic scale derived from the diatonic scale by the omission of at least one of its tones, the instrument comprising:

electronic tone generator means for generating a set of at least twelve musical tones, a set of at least twelve manually operated digitals electrically coupled to said tone generator means, individual digitals playing individual musical tones, the set of digitals arranged in a single continuous keyboard and labeled in order of sequence in the keyboard by successively increasing ordinal numbers L, where L ranges from one to at least twelve, successive members of the sequence of digitals playing tones of successively higher pitch selected from said set of tones, an octave span of the keyboard containing exactly M of the digitals, where M is a whole number in the range five to six inclusive, each digital labeled by an ordinal number L which is greater than M playing a tone one octave above the tone played by the digital labeled L-M.

6. Tone transposition apparatus for a musical instrument comprising:

means for generating at least twelve individual musical tones, the tones arranged in a nominally equitempered scale in order of increasing pitch, with musical intervals of a single semitone between consecutive tones of the scale.

eight digitals for playing eight individual musical tones, the digitals arranged in a single predetermined sequence, successive members of the sequence playing a sequence of tones of successively higher pitch, selected from said tones of the nominally equitempered scale, the sequence of the eight relative tones being defined by the sequence of seven interdigital musical intervals between the tones played by consecutive members of the sequence of digitals, an electronic switching network coupling each of the eight digitals to the tone generator means, the switching network having at least first and second switch states corresponding to different sequences of interdigital musical intervals, for a selected pair of adjacent members of the sequence of eight digitals, the interdigital musical interval being at least a semitone greater in the second switch states than it is in the first switch state.

7. Key selector apparatus as recited in claim 6 wherein: in the first switch state the sequence of interdigital musical intervals is selected from the group consisting of:

2-2-1-2-2-2-1 semitones,
2-1-2-2-2-1-2 -semitones
1-2-2-2-1-2-2 semitones, in the second switch state the sequence of interdigital intervals is selected from the group consisting of:

2-2-2-1-2-2-1 semitones,
2-2-1-2-2-1-2 semitones,
2-1-2-2-1-2-2 semitones,
1-2-2-1-2--2-2 semitones.

8. Musical scale selector apparatus as recited in claim 6 wherein: in the first switch state the sequence of interdigital musical intervals defines the diatonic scale, the sequence of interdigital intervals being selected from the group consisting of:

2-2-1-2-2-2-1 semitones,
2-1-2-2-2-1-2 semitones,
1-2-2-2-1-2-2 semitones,
2-2-2-1-2-2-1 semitones,
2-2-1-2-2-1-2 semitones,
2-1-2-2-1-2-2 semitones,
1-2-2-1-2-2-2 semitones, in the second switch state the sequence of interdigital intervals defines a diminished diatonic scale derived from the diatonic scale by the omission of at least one of its tones.

9. Musical scale selector apparatus as recited in claim 8 wherein:

in the second switch state the sequence of interdigital musical intervals defines a pentatonic scale, the interdigital intervals being selected from the group consisting of:

2-2-3-2-3-2-2 semitones,
2-3-2-3-2-2-3 semitones,
3-2-3-2-2-3-2 semitones,
2-3-2-2-3-2-3 semitones,
3-2-2-3-2-3-2 semitones.

* * * * *